US005675975A

United States Patent [19]

Lee

[11] Patent Number: 5,675,975

[45] Date of Patent: Oct. 14, 1997

[54] METHOD FOR CONTROLLING ICE REMOVING MOTOR OF AUTOMATIC ICE PRODUCTION APPARATUS

[75] Inventor: Kun Bin Lee, Seoul, Rep. of Korea

[73] Assignee: Samsung Electronics Co., Ltd., Suwon-City, Rep. of Korea

[21] Appl. No.: 691,458

[22] Filed: Aug. 2, 1996

[30] Foreign Application Priority Data

Dec. 27, 1995 [KR] Rep. of Korea ..... 95-58355

[51] Int. Cl.[6] ..... F25C 5/06

[52] U.S. Cl. ..... 62/72; 62/353

[58] Field of Search ..... 62/72, 233, 353

[56] References Cited

U.S. PATENT DOCUMENTS

| | | | |
|---|---|---|---|
| 3,071,933 | 1/1963 | Shoemaker | 62/353 |
| 3,188,827 | 6/1965 | Bauerlein | 62/353 |
| 3,580,009 | 5/1971 | Snow | 62/353 |
| 3,763,662 | 10/1973 | Nichols | 62/72 |
| 4,332,146 | 6/1982 | Yamazaki et al. | 62/353 |
| 4,424,683 | 1/1984 | Manson | 62/353 |
| 5,400,605 | 3/1995 | Jeong | 62/72 |

*Primary Examiner*—William E. Tapolcai

*Attorney, Agent, or Firm*—Burns, Doane, Swecker & Mathis, L.L.P.

[57] ABSTRACT

An ice tray in an automatic ice making machine of a refrigerator is emptied by being rotated, whereupon the tray becomes deformed to eject the ice. The tray is rotated (and deformed) alternately in opposite directions in order to extend the life of the tray.

1 Claim, 9 Drawing Sheets

METHOD FOR CONTROLLING ICE REMOVING MOTOR OF AUTOMATIC ICE PRODUCTION APPARATUS

BACKGROUND OF THE INVENTION

1. Field of the Invention

The present invention relates in general to controlling an ice removing motor of an automatic ice production apparatus of a refrigerator.

2. Description of the Prior Art

Generally, an automatic ice production apparatus is installed in a freezer compartment of a refrigerator. In the automatic ice production apparatus, water is automatically supplied to a tray and then it is checked whether an ice producing operation has been completed. If the ice producing operation has been completed, produced ice is automatically removed from the tray and then supplied to an ice container. Therefore, the ice production can be very conveniently performed with no separate operation of the user. In this connection, recently, the automatic ice production apparatus has essentially been provided in the refrigerator. Such a conventional automatic ice production apparatus will hereinafter be described with reference to FIGS. 1 to 3D.

Referring to FIG. 1, there is schematically shown, in block form, the construction of a conventional automatic ice production apparatus. As shown in this drawing, the conventional automatic ice production apparatus comprises a power supply unit 1 for supplying power to the automatic ice production apparatus, a tray position discriminator 2 for discriminating a turned position of a tray (not shown), a function selector 3 for allowing the user to select an automatic ice producing function, an ice removing motor rotation controller 5 for controlling a rotating operation of an ice removing motor 4, a water supply motor rotation controller 7 for controlling a rotating operation of a water supply motor 6 which supplies water to the tray, an ice removing discriminator 8 provided under the tray, for checking an ice removing state, and a microcomputer 9 for controlling the above-mentioned components in the automatic ice production apparatus.

FIGS. 2A–2C illustrate the construction of the conventional automatic ice production apparatus. As shown in FIG. 2C, the ice removing motor 4 is disposed at a desired position in a housing 10 of the automatic ice production apparatus. The ice removing motor 4 has a shaft to which a worm gear 11 is fixedly mounted. First to third gears 12–14 are sequentially engaged with the worm gear 11 in such a manner that they can sequentially receive a rotating force of the worm gear 11. A cam gear 15 is engaged with the third gear 14 so that it can be actuated in response to a rotating force of the third gear 14.

A protrusion 16 is provided on the outer surface of the cam gear 15 while a first stopper 17 is mounted to the housing 10 in order to be selectively brought into contact with the protrusion 16, thereby limiting the counterclockwise rotation of the cam gear 15. When the first stopper 17 is brought into contact with the protrusion 16, a tray 18 is maintained at its horizontal state.

A horizontal switch 19 is disposed under the cam gear 15 to sense the horizontal state of the tray 18. A horizontal switch adjustment rib 20 is mounted to the cam gear 15 to switch the horizontal switch 19.

A second stopper 21 is connected to the ice removing motor 4 in such a manner that it can be brought into contact with the protrusion 16 when the cam gear 15 is rotated about 158°, whereby the tray 18 cannot be further rotated.

An ice full switch 22 is disposed adjacently to the horizontal switch 19. When a lever connector 24 is pushed by an ice full lever adjustment rib 23 mounted to the cam gear 15, it turns an ice full lever 25 which is integral therewith, thereby causing the ice full switch 22 to be turned on.

An ice removing sensor (for example, a thermistor) 26 is disposed at a desired position under the tray 18 to sense a temperature variation of the tray 18 to check the ice producing and removing states. The ice removing sensor 26 is also mounted to the ice removing discriminator 8 to check a voltage variation based on the temperature variation of the tray 18 and to provide the result to the ice removing discriminator 8, thereby allowing the ice removing discriminator 8 to recognize the ice producing and removing states.

The operation of the conventional automatic ice production apparatus with the above-mentioned construction will hereinafter be described with respect to FIGS. 1 to 3D.

FIGS. 3A to 3D are views illustrating the operation of the conventional automatic ice production apparatus. First, when an automatic ice producing function key on the function selector 3 is operated by the user to select the automatic ice producing function, the corresponding signal is applied to the microcomputer 9 which is also supplied with a drive voltage from the power supply unit 1.

Upon receiving the automatic ice producing function key signal from the function selector 3, the microcomputer 9 outputs a control signal to the water supply motor rotation controller 7 to drive the water supply motor 6. As the water supply motor 6 is driven, water from a water supply tank (not shown) is supplied to the tray 18. At this time, the tray 18, which is attached to the cam gear 15, remains in its horizontal state as shown in FIG. 3A.

Thereafter, the ice removing discriminator 8 checks whether an ice producing operation has been completed. If the ice producing operation has been completed, the ice removing discriminator 8 outputs a control signal to the microcomputer 9 to inform it of such a situation. In response to the control signal from the ice removing discriminator 8, the microcomputer 9 outputs a control signal to the ice removing motor rotation controller 5 to rotate the ice removing motor 4 in a desired direction (see FIG. 3B). As the ice removing motor 4 is rotated, the tray 18 is turned and inverted above an ice container (not shown). At this time, the tray 18 is held at its one side by a stopper while it is continuously applied at its other side with a rotating force of the ice removing motor 4 (see FIG. 3C). As a result, the tray 18 is distorted.

As the tray 18 is distorted, produced ice is removed therefrom and falls into the ice container. Then, the ice removing discriminator 8 checks whether an ice removing operation has been completed. If the ice removing operation has been completed, the ice removing discriminator 8 outputs a control signal to the microcomputer 9 to inform it of such a situation. In response to the control signal from the ice removing discriminator 8, the microcomputer 9 controls the ice removing motor rotation controller 5 to rotate the ice removing motor 4 in the reverse direction. As a result, the tray 18 is returned to its initial state (see FIG. 3D).

Then, the tray position discriminator 2 checks whether the tray 18 has been returned to its horizontal state. If the tray 18 has been returned to its horizontal state, the tray position discriminator 2 outputs a control signal to the microcomputer 9 to inform it of such a situation. In response to the control signal from the tray position discriminator 2, the microcomputer 9 repeats the above ice producing operation.

In the case where the ice full switch 22 remains in its ON state even in the inverted state of the tray 18 because the ice container is filled with the produced ice, the microcomputer 9 stops the entire operation of the automatic ice production apparatus.

However, the above-mentioned conventional automatic ice production apparatus has a disadvantage in that the tray is continuously distorted in the single direction because the tray is turned only in the same direction to perform the ice removing operation. For this reason, it is difficult for the tray to retain its original form. This results in a reduction in life of the tray.

Another conventional apparatus as disclosed in Japanese Patent Appln. No. 93-90549 shows a restoration method of ice production dish in which the dish is not rotated in the process of restoration of the dish, that is, a lock state becomes relatively short. This apparatus has a disadvantage in that the tray is distorted only in one direction, thereby reducing life of the tray.

SUMMARY OF THE INVENTION

Therefore, the present invention has been made in view of the above problem, and it is an object of the present invention to provide a method for controlling an ice removing motor of an automatic ice production apparatus, in which the ice removing motor is controlled in such a manner that it can alternately perform a normal direction ice removing operation and a reverse direction ice removing operation.

In accordance with the present invention, the above and other objects can be accomplished by a method for controlling an ice removing motor of an automatic ice production apparatus, the automatic ice production apparatus comprising an ice removing motor rotation controller for controlling a rotating operation of the ice removing motor and a microcomputer for controlling the entire operation of the automatic ice production apparatus, the ice removing motor turning a tray to perform an ice removing operation of the automatic ice production apparatus, comprising the first step of determining whether the present condition is an ice removing start condition and initializing a count; the second step of checking whether the count is an even number or an odd number, if it is determined at the first step that the present condition is the ice removing start condition, and rotating the ice removing motor in a desired direction in accordance with the checked result in such a manner that the tray can be distorted at the maximum to remove produced ice therefrom; and the third step of performing water supply and ice producing operations after the second step is completed, determining whether the present condition is the ice removing start condition and incrementing the count by one.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 4:
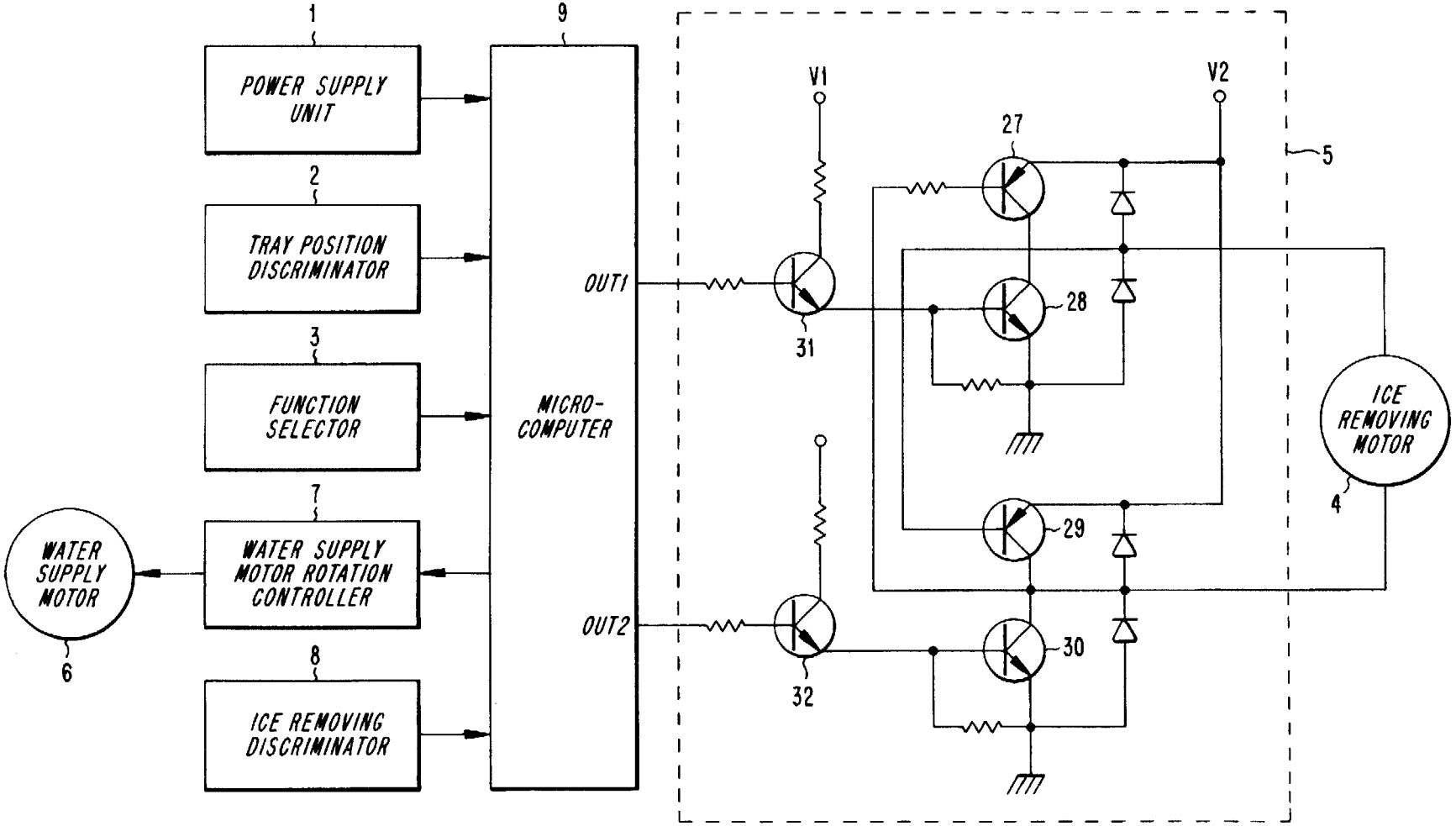
FIG. 4 is a schematic block diagram illustrating the construction of an automatic ice production apparatus in accordance with the present invention.

Referring to FIG. 4, there is schematically shown, in block form, the construction of an automatic ice production apparatus. Some parts in this drawing are the same as those in FIG. 1. Therefore, like reference numerals designate like parts.

Figure 1:
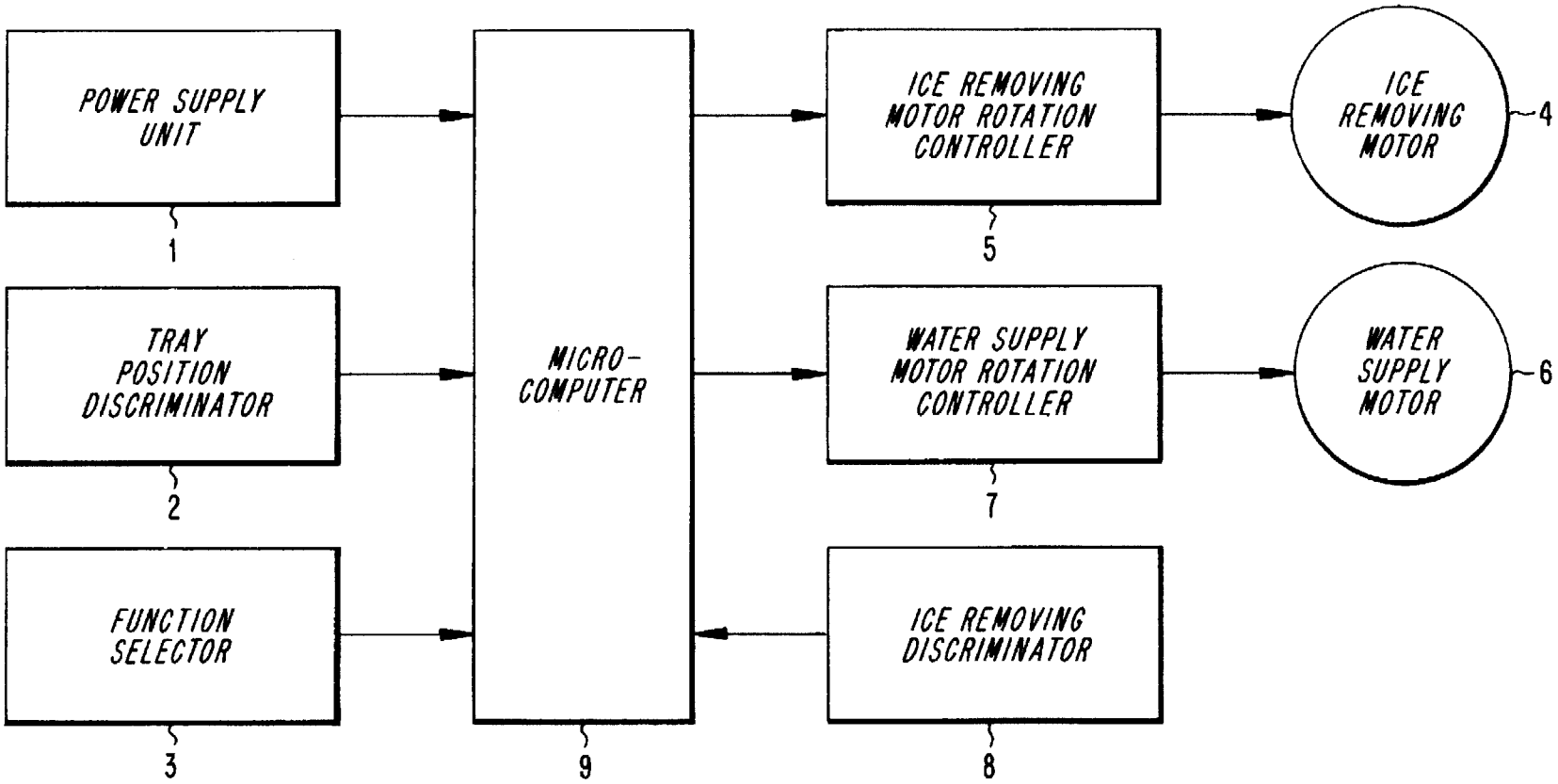
FIG. 1 (PRIOR ART)
FIG. 1 is a schematic block diagram illustrating the construction of a conventional automatic ice production apparatus.

Similarly to the construction of FIG. 1, as shown in FIG. 4, the automatic ice production apparatus comprises the power supply unit 1, the tray position discriminator 2, the function selector 3, the ice removing motor 4, the ice removing motor rotation controller 5, the water supply motor 6, the water supply motor rotation controller 7, the ice removing discriminator 8 and the microcomputer 9.

The ice removing motor rotation controller 5 includes a plurality of switching transistors 27–30 for switching a drive voltage V2 from the power supply unit 1 to the ice removing motor 4 to control a rotating direction of the ice removing motor 4, and a pair of control transistors 31 and 32 being switched under the control of the microcomputer 9 to control the switching operations of the switching transistors 27–30.

The switching transistors 28 and 30 are adapted to switch a ground voltage to the ice removing motor 4 and the switching transistors 27 and 29 are adapted to switch the drive voltage V2 from the power supply unit 1 to the ice removing motor 4.

Also, the switching transistors 28 and 29 are complementarily driven in response to ON and OFF states of the control transistor 31, and the switching transistors 27 and 30 are complementarily driven in response to ON and OFF states of the control transistor 32.

FIG. 5 is a detailed diagram illustrating the construction of the automatic ice production apparatus in accordance with the present invention. Some parts in this drawing are the same as those in FIG. 2. Therefore, like reference numerals designate like parts.

Figure 2A:
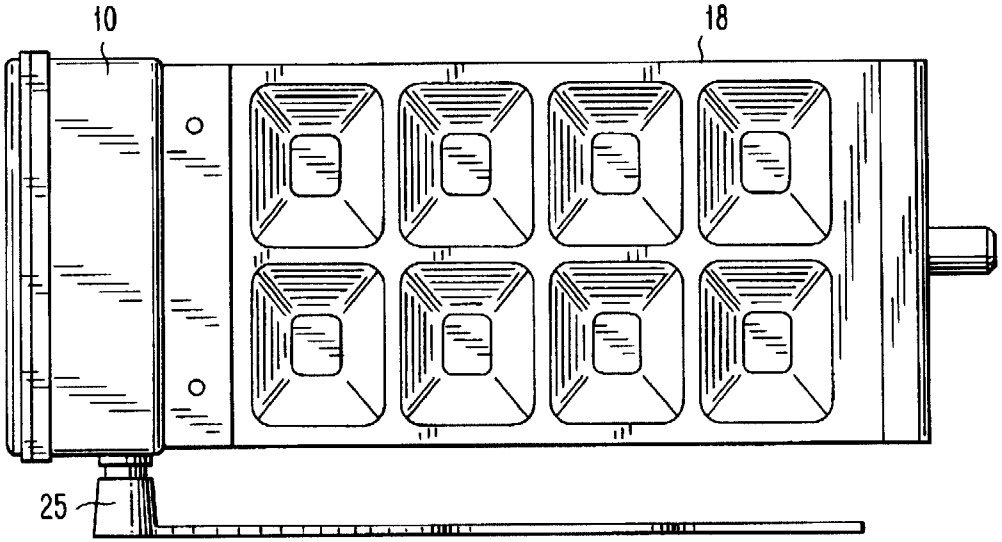
FIG. 2A (PRIOR ART)
FIG. 2A is a top plan view illustrating the construction of the conventional automatic ice production apparatus.
Figure 2B:
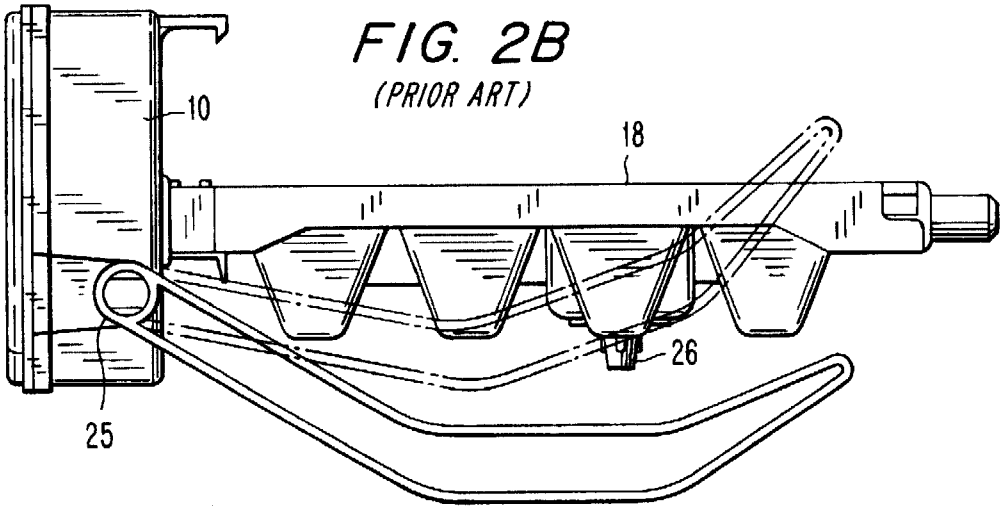
FIG. 2B (PRIOR ART)
FIG. 2B is a side elevational view of the apparatus illustrated in FIG. 2A.
Figure 2C:
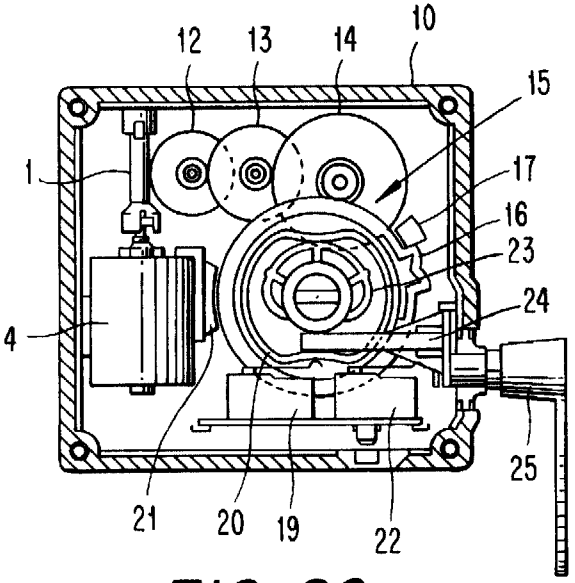
FIG. 2C (PRIOR ART)
FIG. 2C is a sectional view taken through a housing of the apparatus illustrated in FIGS. 2A and 2B.
Figure 3A:
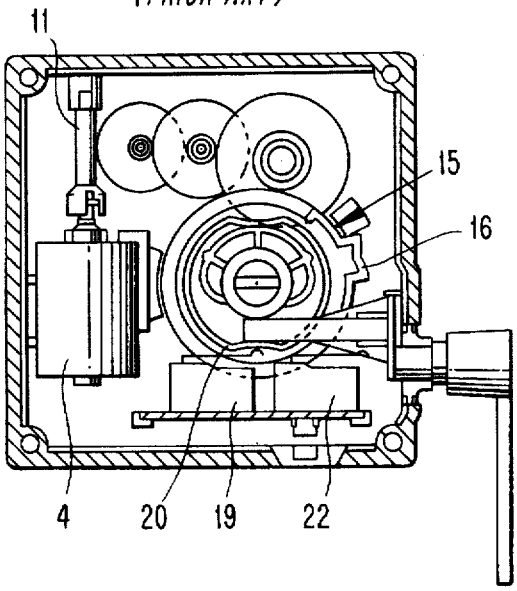
FIG. 3A (PRIOR ART)
FIGS. 3A to 3D are views similar to FIG. 2C illustrating the operation of the conventional automatic ice production apparatus.
Figure 3B:
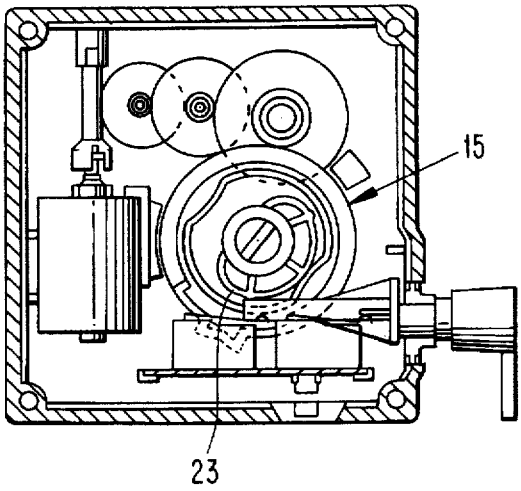
FIG. 3B (PRIOR ART)
Figure 3C:
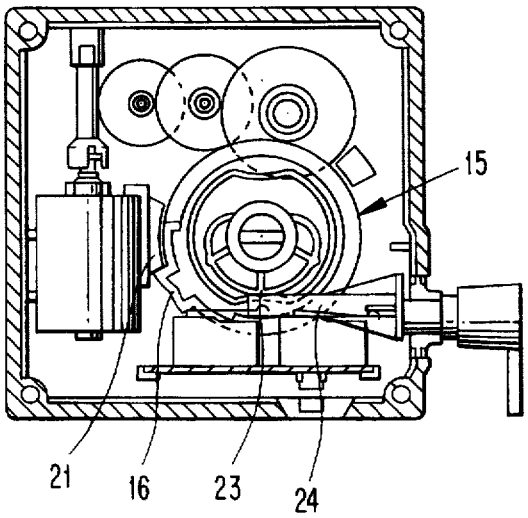
FIG. 3C (PRIOR ART)
Figure 3D:
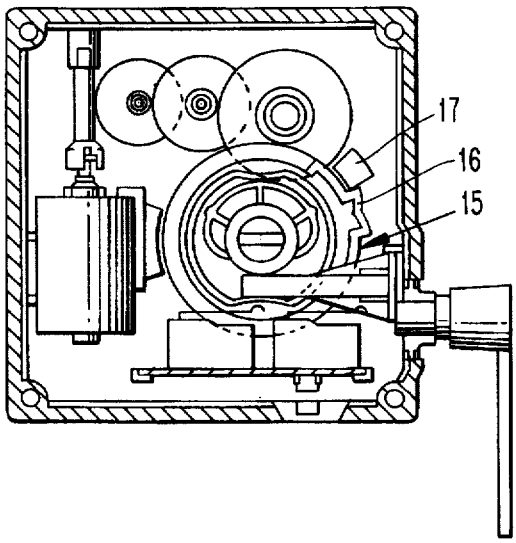
FIG. 3D (PRIOR ART)
Figure 5A:
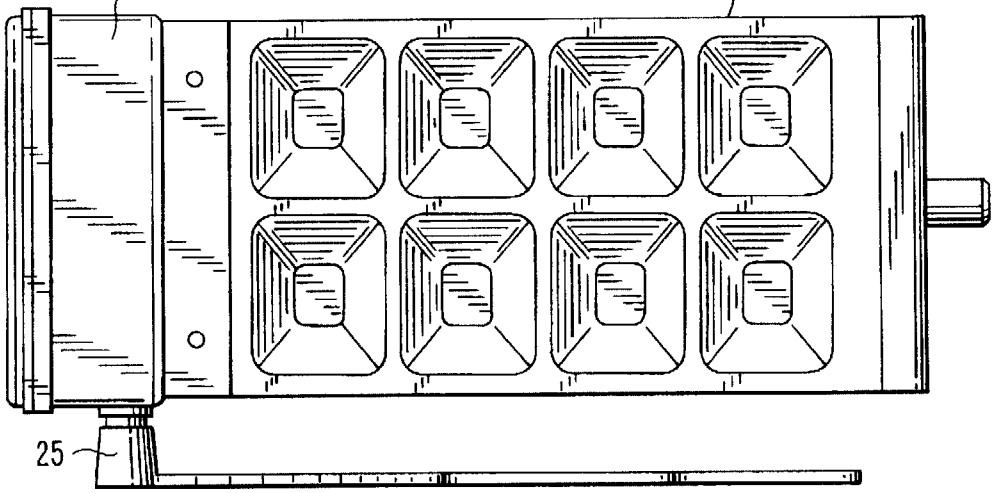
FIG. 5 is a detailed diagram illustrating the construction of the automatic ice production apparatus in accordance with the present invention.
Figure 5B:
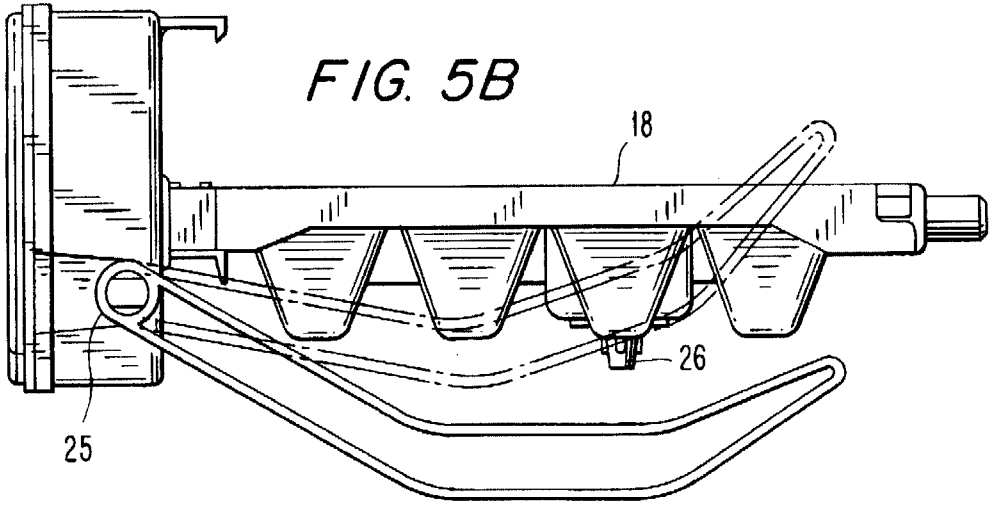
Figure 5C:
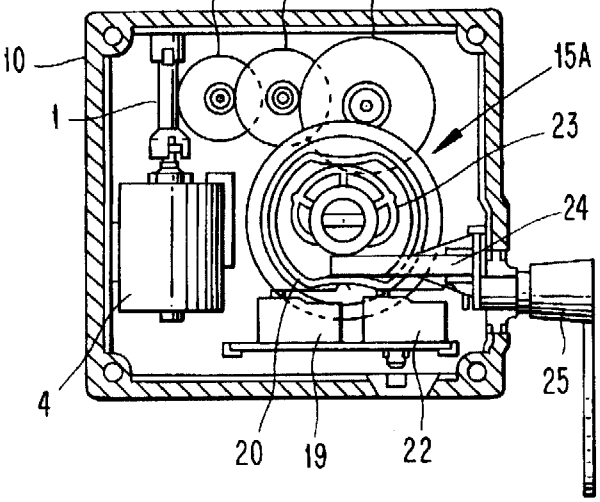

The construction of FIGS. 5A–C is substantially the same as that of FIGS. 2A–C, respectively, with the exception that the protrusion 16 and the first and second stoppers 17 and 21 in FIG. 2C are removed. Also, the horizontal switch adjustment rib 20 and the ice full lever adjustment rib 23 have symmetric configurations, respectively.

The operation of the automatic ice production apparatus with the above-mentioned construction in accordance with the present invention will hereinafter be described in detail with reference to FIGS. 6A to 7G.

Figure 6A:
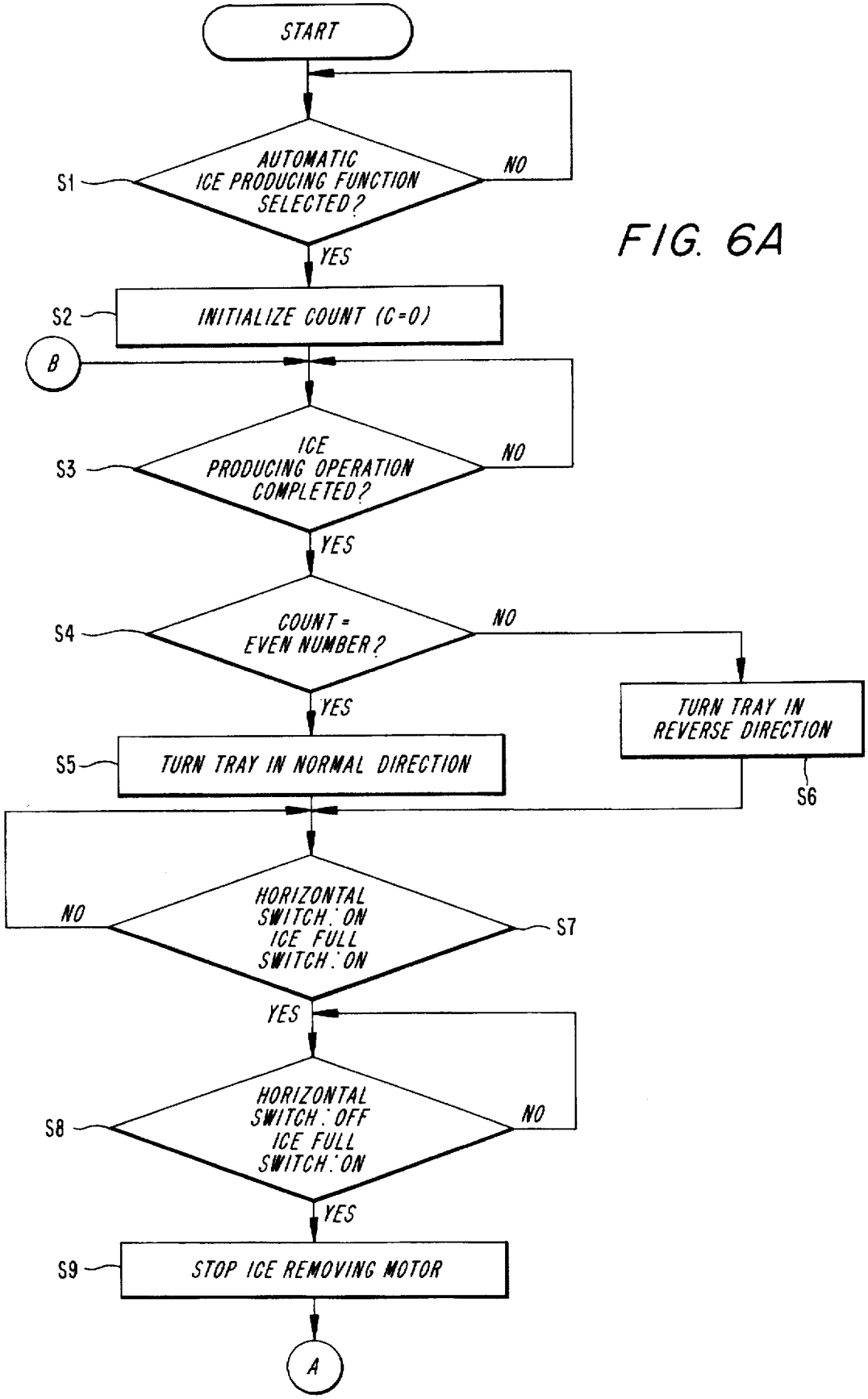
FIGS. 6A and 6B are flowcharts illustrating the operation of a microcomputer in FIG. 4.
Figure 7E:
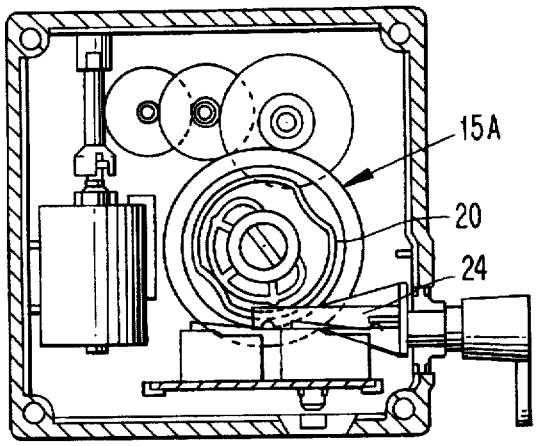
FIGS. 7A to 7G are views illustrating the operation of the automatic ice production apparatus in accordance with the present invention.
Figure 7F:
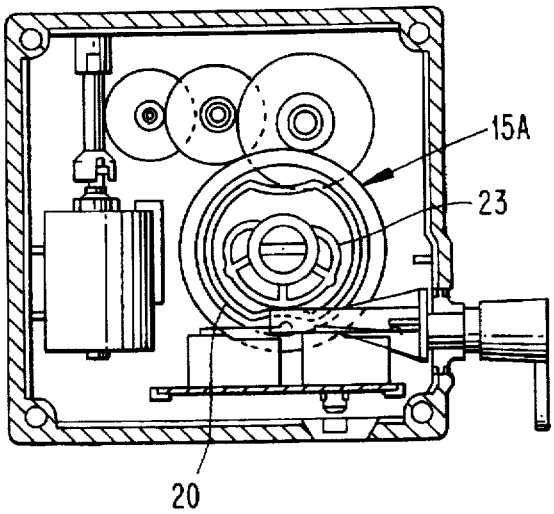
Figure 7G:
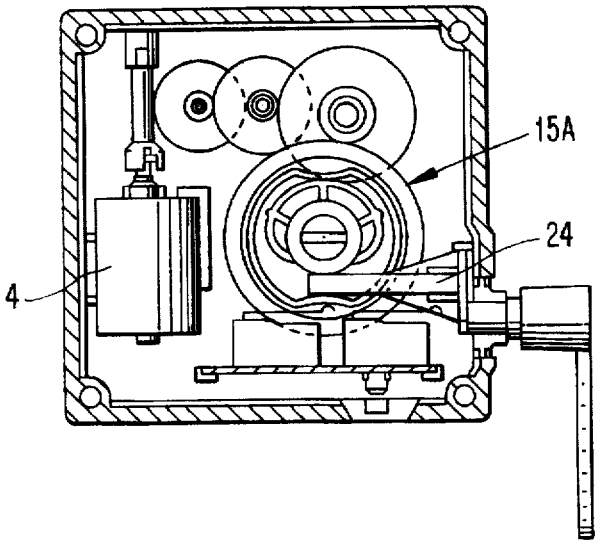
Figure 6B:
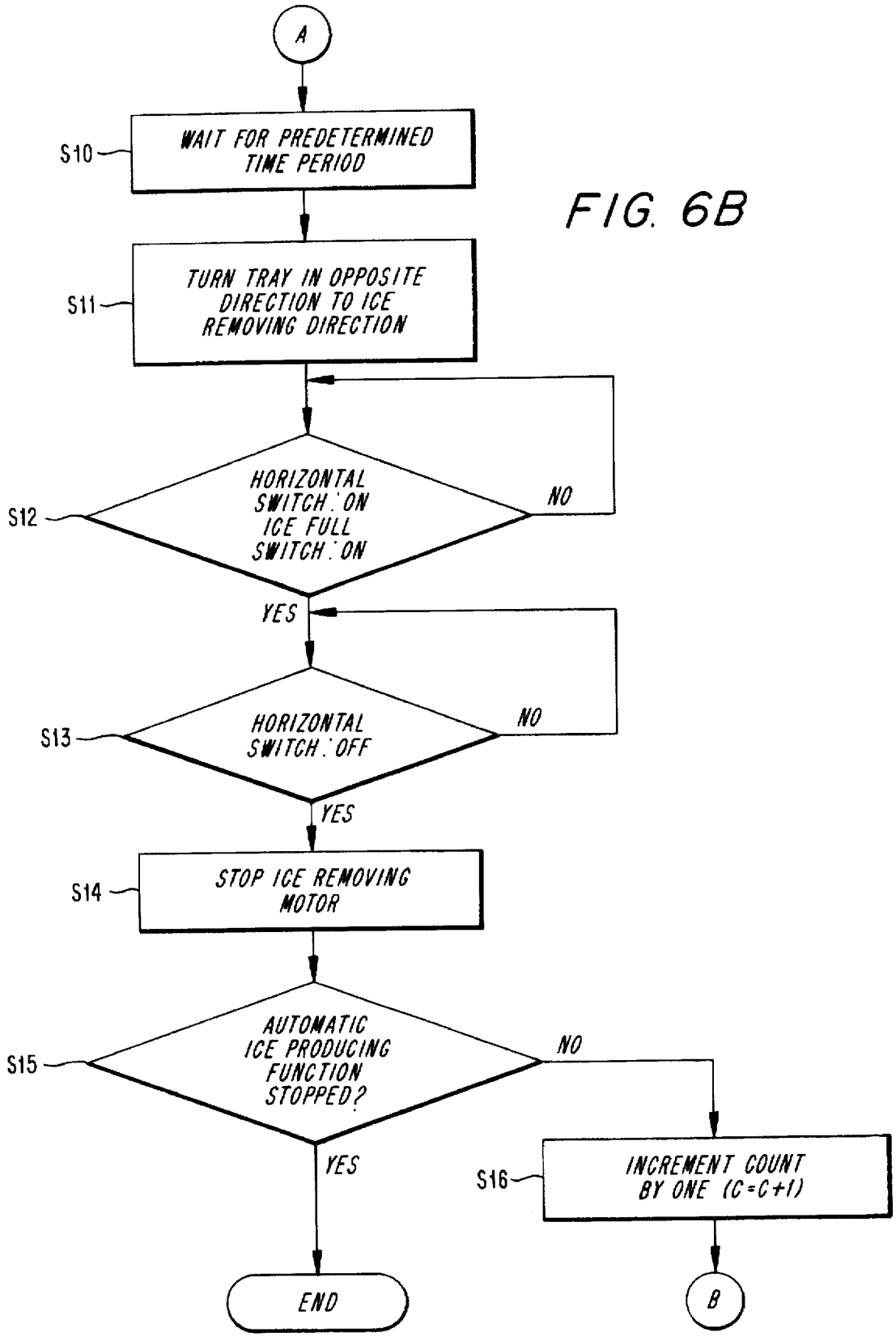

FIGS. 6A and 6B are flowcharts illustrating the operation of the microcomputer 9 in FIG. 4, and FIGS. 7A to 7G are views illustrating the operation of the automatic ice production apparatus in accordance with the present invention.

Figure 7A:
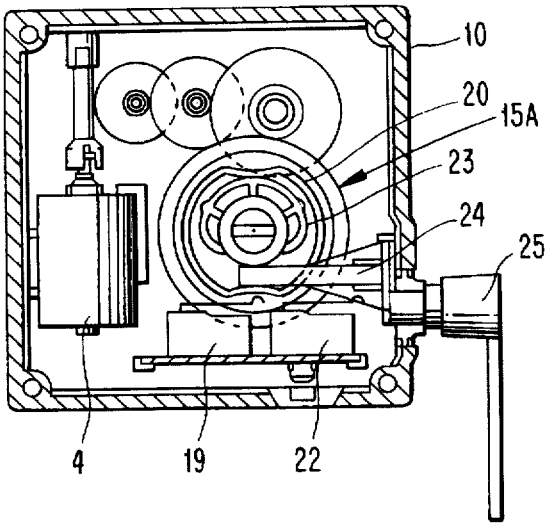
Figure 7B:
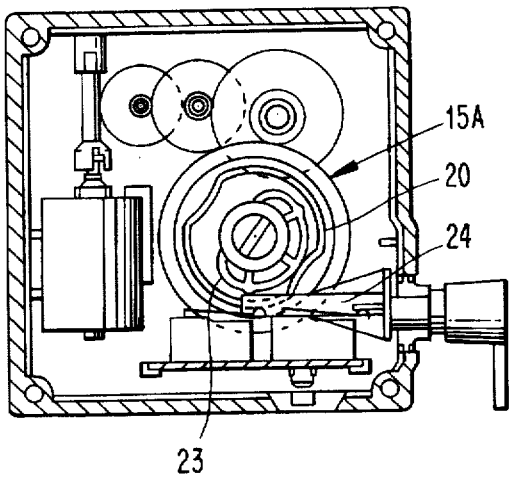
Figure 7C:
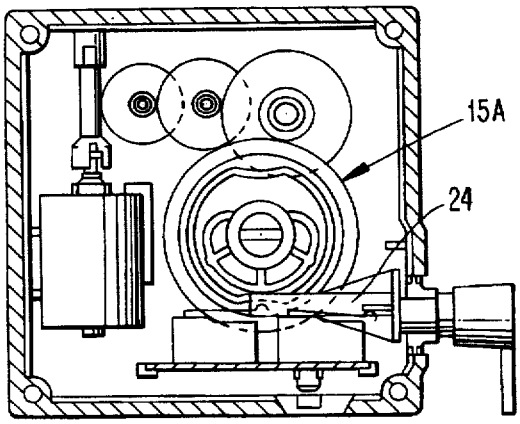
Figure 7D:
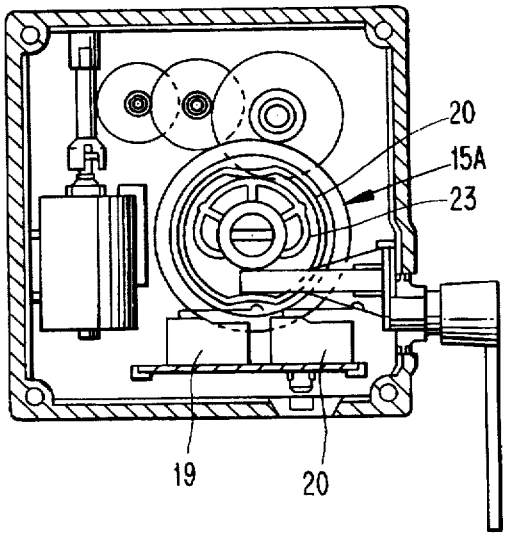

First, in FIG. 6A, the microcomputer 9 checks at step S1 whether the automatic ice producing function has been selected by the user. If the automatic ice producing function has not been selected by the user at step S1, the horizontal switch 19 is positioned in a concave portion of the horizontal switch adjustment rib 20 mounted to the cam gear 15A under the condition that the automatic ice production apparatus remains at its stopped state, as shown in FIG. 7A. As a result, the horizontal switch 19 remains in its OFF state. Also as shown in FIG. 7A, the lever connector 24 is not pushed but positioned in a concave portion of the ice full lever adjustment rib 23 mounted to the cam gear 15. As a result, the ice full lever 25 is not turned and the ice full switch 22 remains in its OFF state.

In the case where it is determined at step S1 that the automatic ice producing function has been selected by the user, the microcomputer 9 initializes a count (i.e., C=0) at step S2 and outputs a control signal to the ice removing discriminator 8 at step S3 to check whether the ice producing operation has been completed. If the ice producing operation has not been completed, the microcomputer 9 returns to step S2 to continue to check whether the ice producing operation has been completed.

When it is determined at step S3 that the ice producing operation has been completed, the microcomputer 9 checks at step S4 whether the count is an even number. If the count is an even number, the microcomputer 9 controls the ice removing motor rotation controller 5 at step S5 to turn the tray 18 in the normal (first) direction. To the contrary, if it is determined at step S4 that the count is an odd number, the microcomputer 9 controls the ice removing motor rotation controller 5 at step S6 to turn the tray 18 in the reverse (second) direction.

In other words, the microcomputer 9 outputs a low logic control signal at its first output terminal OUT1 and a high logic control signal at its second output terminal OUT2. In the ice removing motor rotation controller 5, the control transistor 31 inputs the low logic control signal from the first output terminal OUT1 of the microcomputer 9 at its base terminal and the control transistor 32 inputs the high logic control signal from the second output terminal OUT2 of the microcomputer 9 at its base terminal. Preferably, the control transistors 31 and 32 are of the NPN type. As a result, the control transistor 31 is turned off in response to the low logic control signal from the first output terminal OUT1 of the microcomputer 9 and the control transistor 32 is turned on in response to the high logic control signal from the second output terminal OUT2 of the microcomputer 9. As the control transistor a 1 is turned off, the switching transistors 28 and 29 are turned off.

As the control transistor 32 is turned on, it transfers a drive voltage V1 from the power supply unit 1 to a base terminal of the switching transistor 30, thereby causing the switching transistor 30 to be turned on. As the switching transistor 30 is turned on, the ground voltage is transferred to a collector terminal of the switching transistor 30 and a low logic signal is thus applied to a base terminal of the switching transistor 27. Preferably, the switching transistor 27 is of the PNP type. As a result, the switching transistor 27 is turned on in response to the low logic signal. The turning-on of the switching transistor 27 forms a loop of power supply unit 1→switching transistor 27→ice removing motor 4→switching transistor 30→ground terminal. With the loop formed, the drive voltage V2 from the power supply unit 1 is supplied to the ice removing motor 4 to rotate it clockwise. As the ice removing motor 4 is rotated, the earn gear 15A is rotated to tun the tray 18 mounted thereto.

On the other hand, if the microcomputer 9 outputs a high logic control signal at its first output terminal OUT1 and a low logic control signal at its second output terminal OUT2, the high logic control signal from the first output terminal OUT1 is applied to the base terminal of the control transistor 31 and the low logic control signal from the second output terminal OUT2 is applied to the base terminal of the control transistor 32. Because the control transistors 31 and 32 are of the NPN type, the control transistor 31 is turned on in response to the high logic control signal from the first output terminal OUT1 of the microcomputer 9 and the control transistor 32 is turned off in response to the low logic control signal from the second output terminal OUT2 of the microcomputer 9. As the control transistor 32 is turned off, the switching transistors 27 and 30 are turned off.

As the control transistor 31 is turned on, it transfers the drive voltage V1 from the power supply unit 1 to a base terminal of the switching transistor 28, thereby causing the switching transistor 28 to be turned on. As the switching transistor 28 is turned on, the ground voltage is transferred to a collector terminal of the switching transistor 28 and a low logic signal is thus applied to a base terminal of the switching transistor 29. Preferably, the switching transistor 29 is of the PNP type. As a result, the switching transistor 29 is turned on in response to the low logic signal. The tuning-on of the switching transistor 29 forms a loop of power supply unit 1→switching transistor 29→ice removing motor 4→switching transistor 28→ground terminal. With the loop formed, the drive voltage V2 from the power supply unit 1 is supplied to the ice removing motor 4 to rotate it counterclockwise. As the ice removing motor 4 is rotated, the cam gear 15A is rotated to turn the tray 18 mounted thereto.

As stated previously, as the tray 18 is turned, the horizontal switch adjustment rib 20 mounted to the cam gear 15A is turned in such a manner that a convex portion thereof can push the horizontal switch 19 to turn it on. Also, the lever connector 24 is pushed by a convex portion of the ice full lever adjustment rib 23 mounted to the cam gear 15A, so as to turn the ice full lever 25. Also, the ice full switch 22 is turned on by the lever connector 24. At this time, the microcomputer 9 checks at step S7 that the horizontal switch 19 and the ice full switch 22 are in their ON states and thus determines that the automatic ice production apparatus has been set to an ice removing ready state (see FIGS. 7B and 7E).

Thereafter, as the tray 18 is further turned from the ice removing ready state, the horizontal switch adjustment rib 20 mounted to the cam gear 15A is turned in such a manner that the concave portion thereof can receive the horizontal switch 19. As a result, the horizontal switch 19 is changed from its ON state to its OFF state. The lever connector 24 is still pushed by the convex portion of the ice full lever adjustment rib 23 mounted to the cam gear 15A, thereby allowing the ice full lever 25 to remain at its turned state. Also, the ice full switch 22 remains in its ON state. At this time, the microcomputer 9 checks at step S8 whether the horizontal switch 19 is in its OFF state and the ice full switch 22 is in its ON state and thus determines that the automatic ice production apparatus has been set to the ice removing state (see FIGS. 7C and 7F). Hence, the microcomputer 9 controls the ice removing motor rotation controller 5 at step S9 to stop the ice removing motor 4.

Then, at step S10, the microcomputer 9 waits for a predetermined time period until produced ice is removed from the tray 18. When the predetermined time period has elapsed, the microcomputer 9 controls the ice removing motor rotation controller 5 at step S11 to turn the tray 18 in the opposite direction to the ice removing direction. As the tray 18 is turned, the horizontal switch adjustment rib 20 mounted to the cam gear 15A is turned in such a manner that the convex portion thereof can push the horizontal switch 19 to turn it on. The lever connector 24 is still pushed by the convex portion of the ice full lever adjustment rib 23 mounted to the cam gear 15A, thereby allowing the ice full lever 25 to remain at its turned state. As a result, the ice full switch 22 remains in its ON state. At this time, the microcomputer 9 checks at step S12 that the horizontal switch 19 and the ice full switch 22 are in their ON states and thus determines that the automatic ice production apparatus has been set to a returning state.

Thereafter, as the tray 18 is continuously turned, the horizontal switch 19 is positioned in the concave portion of the horizontal switch adjustment rib 20 and the lever connector 24 is positioned in the concave portion of the ice full lever adjustment rib 23. As a result, the horizontal switch 19 and the ice full switch 22 are changed from their ON states to their OFF states. At this time, the microcomputer 9 checks at step S13 whether the horizontal switch 19 is in its OFF state and thus determines that the automatic ice production apparatus has been returned to its initial state (see FIGS. 7D and 7G). Hence, the microcomputer 9 controls the ice removing motor rotation controller 5 at step S14 to stop the ice removing motor 4. Noticeably, as the ice container is filled with the produced ice, the ice full lever 25 is raised, thereby causing the ice full switch 22 to be turned on. In this connection, it is preferred that, if the horizontal switch 19 is turned off, the microcomputer 9 determines regardless of the ON/OFF states of the ice full switch 22 that the tray 18 has been returned to its horizontal state.

Then, the microcomputer 9 checks at step S15 whether the automatic ice producing function has been stopped by the user. If the automatic ice producing function has not been stopped by the user, the microcomputer 9 increments the count by one (i.e., C=C+1) at step S16 and returns to the above step S3 to repeat it and the subsequent steps. To the contrary, in the case where it is determined at step S15 that the automatic ice producing function has been stopped by the user, the microcomputer 9 ends the entire operation.

In the case where the automatic ice producing function is continuously performed, the count is changed from an odd number to an even number and vice versa at step S4 because it is incremented by one, resulting in a change in the turning direction of the tray 18. Therefore, the tray 18 can alternately perform the normal direction ice removing operation and the reverse direction ice removing operation so that it can be prevented from being distorted or damaged.

As apparent from the above description, according to the present invention, the tray alternately performs the normal direction ice removing operation and the reverse direction ice removing operation so that it can be prevented from being distorted or damaged. Therefore, the tray can be increased in life.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for removing ice from an ice tray of an automatic ice production apparatus, said apparatus comprising an ice tray, a motor connected to said tray for rotating said motor selectively in first and second directions for rotating said tray in first and second directions of rotation, respectively, a motor rotation controller for controlling rotation of said motor, and a microcomputer for controlling said motor rotation controller; said tray being deformed when rotated in each of said first and second directions of rotation, respectively; said method comprising the steps of:

A. determining whether a present condition is an ice removing start condition and initializing a count;

B. checking whether the count is an even number or an odd number when it is determined in step A that the present condition is the ice removing start condition; and C. rotating said motor in said first direction when said count is an even number to rotate said tray in said first direction of rotation to cause said tray to be deformed, and rotating said motor in said second direction when said count is an odd number to rotate said tray in said second direction of rotation to cause said tray to be deformed; and D. performing water supply and ice producing operations after said step C is completed; and E. repeating steps A–D while changing the count in step A by one.

* * * * *